US008777008B2

(12) United States Patent
Hu

(10) Patent No.: US 8,777,008 B2
(45) Date of Patent: Jul. 15, 2014

(54) PACKAGE CUSHIONING STRUCTURE FOR LIQUID CRYSTAL DISPLAY MODULE

(75) Inventor: Qianshuang Hu, Shenzhen (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 13 days.

(21) Appl. No.: 13/699,057

(22) PCT Filed: Sep. 13, 2012

(86) PCT No.: PCT/CN2012/081316

§ 371 (c)(1),
(2), (4) Date: Nov. 22, 2012

(87) PCT Pub. No.: WO2014/032336

PCT Pub. Date: Mar. 6, 2014

(65) Prior Publication Data

US 2014/0061092 A1 Mar. 6, 2014

(51) Int. Cl.

| | |
|---|---|
| ***B65D 85/30*** | (2006.01) |
| ***B65D 81/05*** | (2006.01) |
| ***B65D 85/48*** | (2006.01) |
| ***B65D 25/10*** | (2006.01) |

(52) U.S. Cl.

CPC ..... *B65D 81/051* (2013.01); *B65D 85/48* (2013.01); *B65D 81/055* (2013.01); *B65D 81/057* (2013.01); *B65D 25/103* (2013.01)

USPC ..... 206/454; 206/587

(58) Field of Classification Search

USPC ..... 206/454, 523, 587–594, 425, 485

See application file for complete search history.

(56) References Cited

U.S. PATENT DOCUMENTS

| | | | | |
|---|---|---|---|---|
| 8,251,220 | B2 * | 8/2012 | Ting et al. | 206/587 |
| 2013/0233759 | A1 * | 9/2013 | Chan et al. | 206/589 |

FOREIGN PATENT DOCUMENTS

| | | | |
|---|---|---|---|
| CN | 101659339 | A | 3/2010 |
| CN | 201512217 | U | 6/2010 |
| CN | 202244650 | U | 5/2012 |
| CN | 102616463 | A | 8/2012 |
| JP | 200119042 | A | 1/2001 |
| KR | 20070114944 | A | 12/2007 |

* cited by examiner

*Primary Examiner* — Bryon Gehman

(74) *Attorney, Agent, or Firm* — Andrew C. Cheng

(57) ABSTRACT

Disclosed is a package cushioning structure for liquid crystal display modules, which includes two opposite cushioning side boards, a plurality of cushioning position-limiting boards arranged between the two cushioning side boards, and a plurality of connection plates connecting the cushioning side boards and the cushioning position-limiting boards. The cushioning side boards form first retention slots corresponding to the connection plates. The cushioning position-limiting boards form second retention slots corresponding to the connection plates. The connection plates form first and second coupling sections respectively corresponding to the first and second retention slots, whereby the first and second coupling sections are respectively received in and retained by the first and second retention slots to couple the cushioning side boards and the cushioning position-limiting boards together in a releasable manner.

11 Claims, 9 Drawing Sheets

PACKAGE CUSHIONING STRUCTURE FOR LIQUID CRYSTAL DISPLAY MODULE

BACKGROUND OF THE INVENTION

1. Field of the Invention

The present invention relates to the field of packaging, and in particular to a package cushioning structure for liquid crystal display module.

2. The Related Arts

To protect a liquid crystal display module in order to prevent the liquid crystal display module from being impacted by an external force and falling during a shipping process, cushioning materials are often arranged inside a package case to disperse an external force acting thereon and to absorb the impact energy induced by falling.

A conventional cushioning material used in a packing case of liquid crystal display module is schematically shown in FIG. 1. Taking the package of a 31.5" module as an example, a cushioning structure 10 comprises a cushioning bottom board 100, two cushioning side boards 300 mounted on the cushioning bottom board 100 at two opposite ends of the cushioning bottom board 100, and three cushioning position-limiting boards 500 arranged, in a spaced manner, between the two cushioning side boards 300. The two cushioning side boards 300 each form a plurality of mounting slots 301. Each of the cushioning position-limiting boards 500 forms a plurality of position-limiting slots 501 corresponding to the mounting slots 301.

In shipping liquid crystal display modules, the cushioning structure 10 is first placed in a packing base 30 (as shown in FIG. 2) and then the liquid crystal display modules are respectively inserted into the mounting slots 301 and the position-limiting slots 501 to ensure effective protection of the liquid crystal display modules against damage of the liquid crystal display modules caused by external forces.

Baling of such a unitary cushioning structure is generally done as that shown in FIG. 3 for shipping. Two such cushioning structures are stacked in a vertical reversed and alternating manner and are then baled, whereby an overall size is 898×363×138 mm, which is equal to a volume of 44984412 $mm^3$. This takes a large amount of space, making the shipping cost high and leading to a high purchase cost.

SUMMARY OF THE INVENTION

An object of the present invention is to provide a package cushioning structure, which is of a split arrangement and has a simple structure so as to facilitate shipping and effectively lower down the shipping cost.

To achieve the objective, the present invention provides a package cushioning structure for liquid crystal display module, which comprises two opposite cushioning side boards, a plurality of cushioning position-limiting boards arranged between the two cushioning side boards, and a plurality of connection plates connecting the cushioning side boards and the cushioning position-limiting boards. The cushioning side boards form first retention slots corresponding to the connection plates. The cushioning position-limiting boards form second retention slots corresponding to the connection plates. The connection plates form first and second coupling sections respectively corresponding to the first and second retention slots, whereby the first and second coupling sections are respectively received in and retained by the first and second retention slots to couple the cushioning side boards and the cushioning position-limiting boards together in a releasable manner.

The cushioning side boards form a plurality of spaced mounting slots and the cushioning position-limiting boards form a plurality of position-limiting slots corresponding to the mounting slots.

The position-limiting slots have a width that is equal to width of the mounting slots and is greater than or equal to thickness of a liquid crystal display module.

The connection plates are of a number of two.

The two cushioning side boards each form two first retention slots respectively arranged at opposite ends of each of the two cushioning side boards. The mounting slots are uniformly distributed between the two first retention slots. The first retention slots have a width less than thickness of the mounting slots and smaller than or equal to thickness of the connection plates.

The cushioning position-limiting boards are of a number of three. Each of the cushioning position-limiting boards forms two second retention slots. The two second retention slots are arranged at opposite ends of the cushioning position-limiting board and correspond to the first retention slots. The position-limiting slots are uniformly distributed between the two second retention slots. The second retention slots have a width that is equal to the width of the first retention slots.

The cushioning side boards are set in an inverted "L" shape.

The connection plates are made of corrugated board or hollow PP boards.

The second retention slots and the position-limiting slots are arranged at the same side of the cushioning position-limiting boards and the first and second coupling sections are located at the same side of the connection plates.

The second retention slots and the position-limiting slots are respectively arranged at opposite sides of the cushioning position-limiting boards and the first and second coupling sections are respectively located at opposite sides of the connection plates.

The present invention also provides a package cushioning structure for liquid crystal display module, which comprises two opposite cushioning side boards, a plurality of cushioning position-limiting boards arranged between the two cushioning side boards, and a plurality of connection plates connecting the cushioning side boards and the cushioning position-limiting boards, the cushioning side boards forming first retention slots corresponding to the connection plates, the cushioning position-limiting boards forming second retention slots corresponding to the connection plates, the connection plates forming first and second coupling sections respectively corresponding to the first and second retention slots, whereby the first and second coupling sections are respectively received in and retained by the first and second retention slots to couple the cushioning side boards and the cushioning position-limiting boards together in a releasable manner;

wherein the cushioning side boards form a plurality of spaced mounting slots and the cushioning position-limiting boards form a plurality of position-limiting slots corresponding to the mounting slots;

wherein the position-limiting slots have a width that is equal to width of the mounting slots and is greater than or equal to thickness of a liquid crystal display module;

wherein the connection plates are of a number of two;

wherein the two cushioning side boards each form two first retention slots respectively arranged at opposite ends of each of the two cushioning side boards, the mounting slots being uniformly distributed between the two first retention slots, the first retention slots have a width less than thickness of the mounting slots and smaller than or equal to thickness of the connection plates;

wherein the cushioning position-limiting boards are of a number of three, each of the cushioning position-limiting boards forming two second retention slots, the two second retention slots being arranged at opposite ends of the cushioning position-limiting board and corresponding to the first retention slots, the position-limiting slots being uniformly distributed between the two second retention slots, the second retention slots having a width that is equal to the width of the first retention slots;

wherein the cushioning side boards are set in an inverted "L" shape;

wherein the connection plates are made of corrugated board or hollow PP boards; and wherein the second retention slots and the position-limiting slots are arranged at the same side of the cushioning position-limiting boards and the first and second coupling sections are located at the same side of the connection plates.

The efficacy of the present invention is that the present invention provides a package cushioning structure for liquid crystal display module, which uses connection plates to couple cushioning side boards and cushioning position-limiting boards together in a releasable manner to effect cushioning external forces acting on liquid crystal display modules thereby effectively protecting the liquid crystal display modules against damages caused by the external forces. Further, the cushioning structure is a separable structure, whereby identical components can be baled together for transportation so as to save a great amount of space and effectively lower down the transportation cost.

For better understanding of the features and technical contents of the present invention, reference will be made to the following detailed description of the present invention and the attached drawings. However, the drawings are provided for the purposes of reference and illustration and are not intended to impose undue limitations to the present invention.

BRIEF DESCRIPTION OF THE DRAWINGS

The technical solution, as well as beneficial advantages, of the present invention will be apparent from the following detailed description of an embodiment of the present invention, with reference to the attached drawings. In the drawings.

DETAILED DESCRIPTION OF THE PREFERRED EMBODIMENTS

Figure 1:
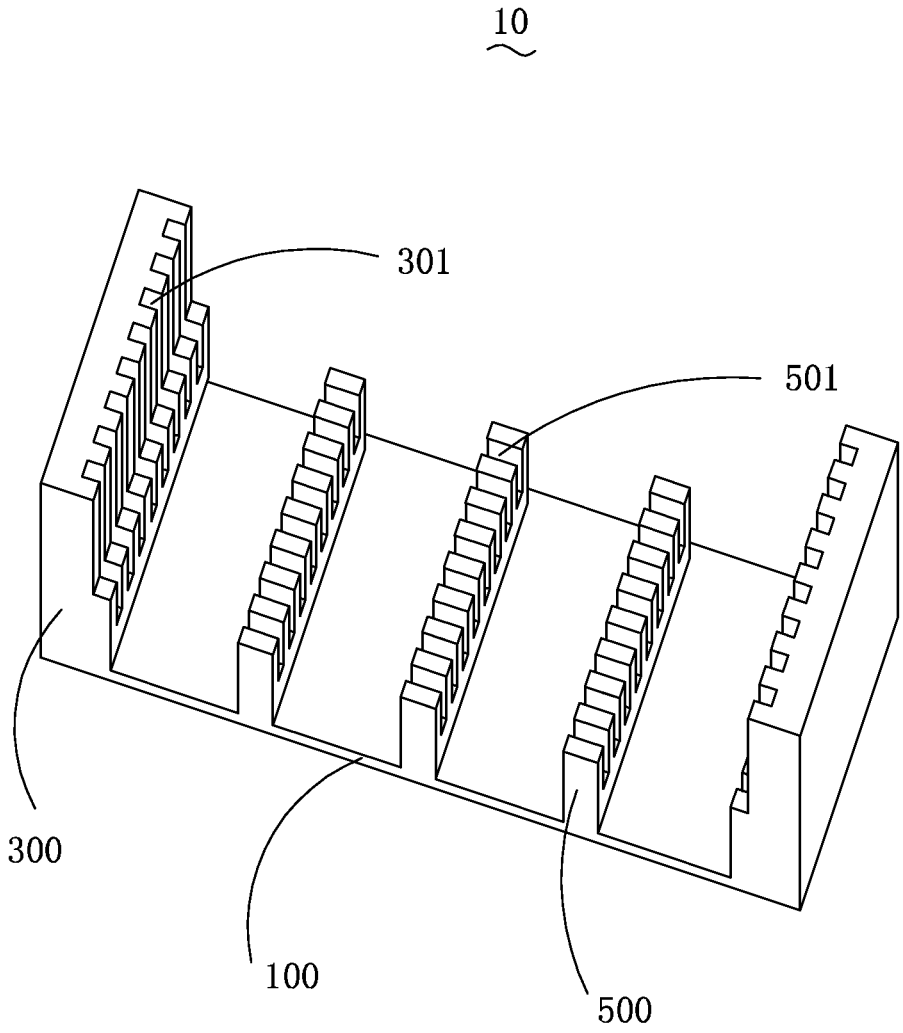
FIG. 1 is a schematic view showing a conventional package cushioning structure for liquid crystal display module.
Figure 2:
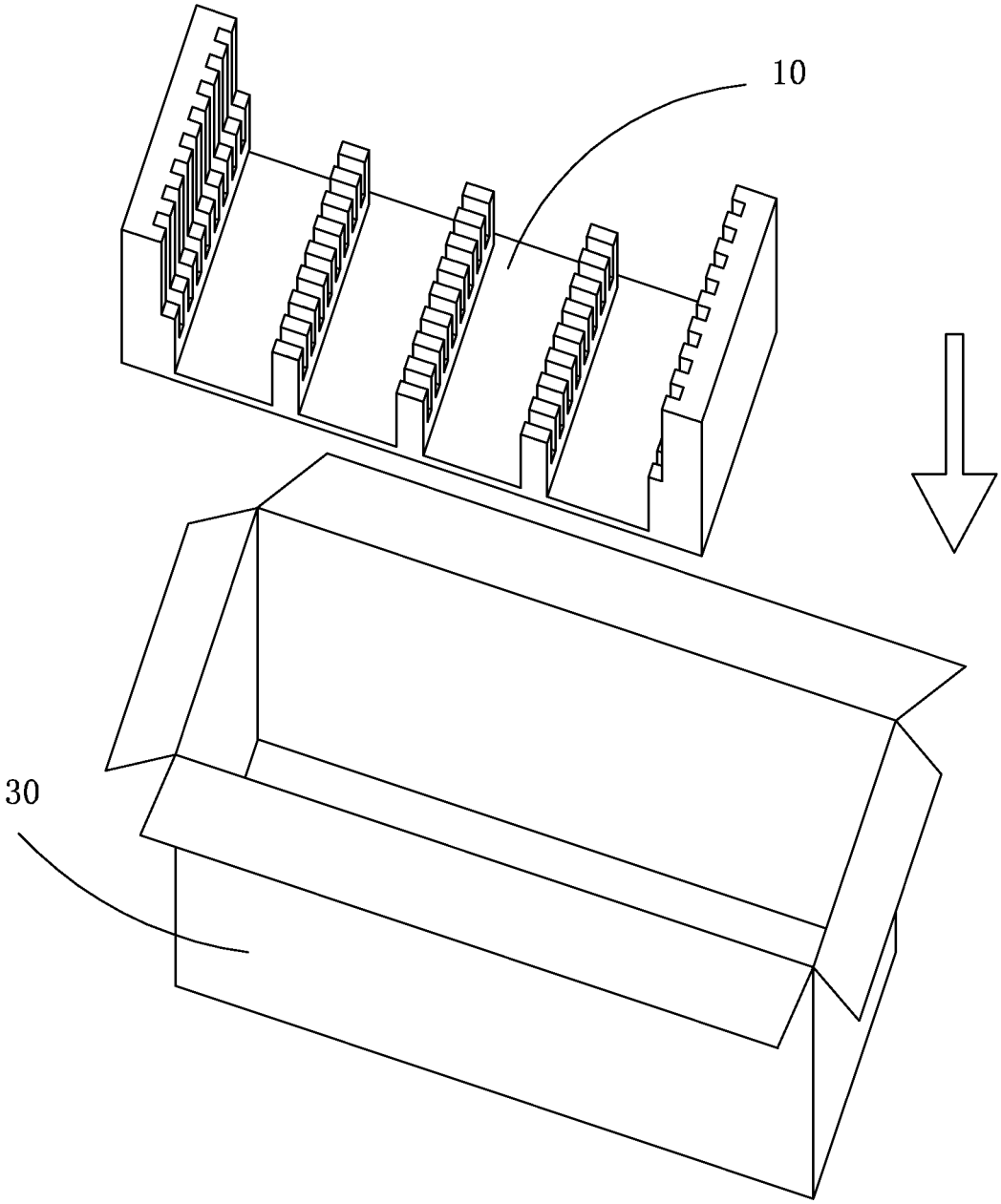
FIG. 2 is a schematic view illustrating an operation of placing the conventional package cushioning structure for liquid crystal display module in a case.
Figure 3:
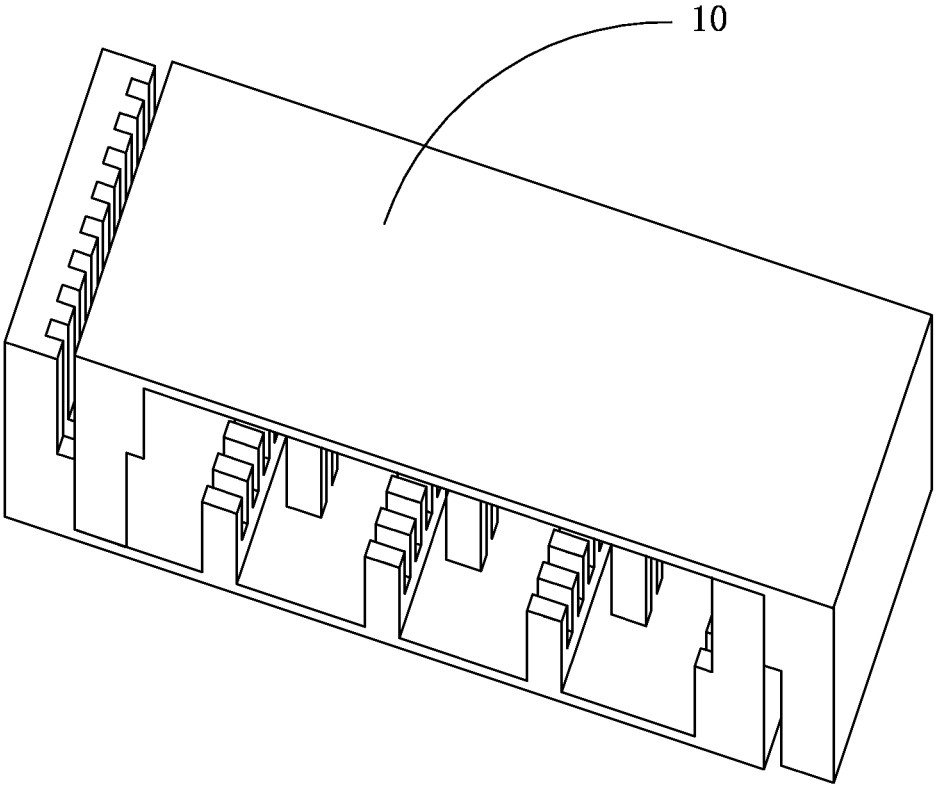
FIG. 3 is a schematic view illustrating two package cushioning structures for liquid crystal display module that are stacked in shipping of the package cushioning structures for liquid crystal display module.
Figure 4:
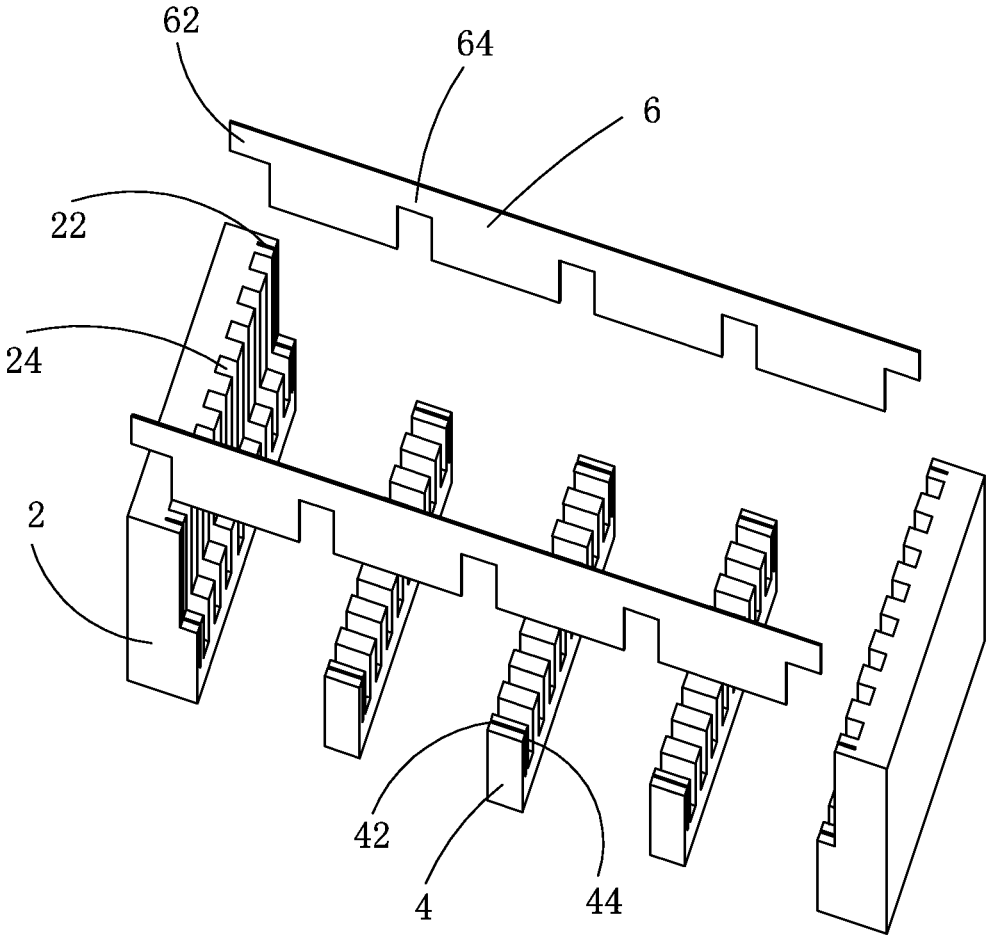
FIG. 4 is an exploded view showing a package cushioning structure for liquid crystal display module according to a preferred embodiment of the present invention.
Figure 5:
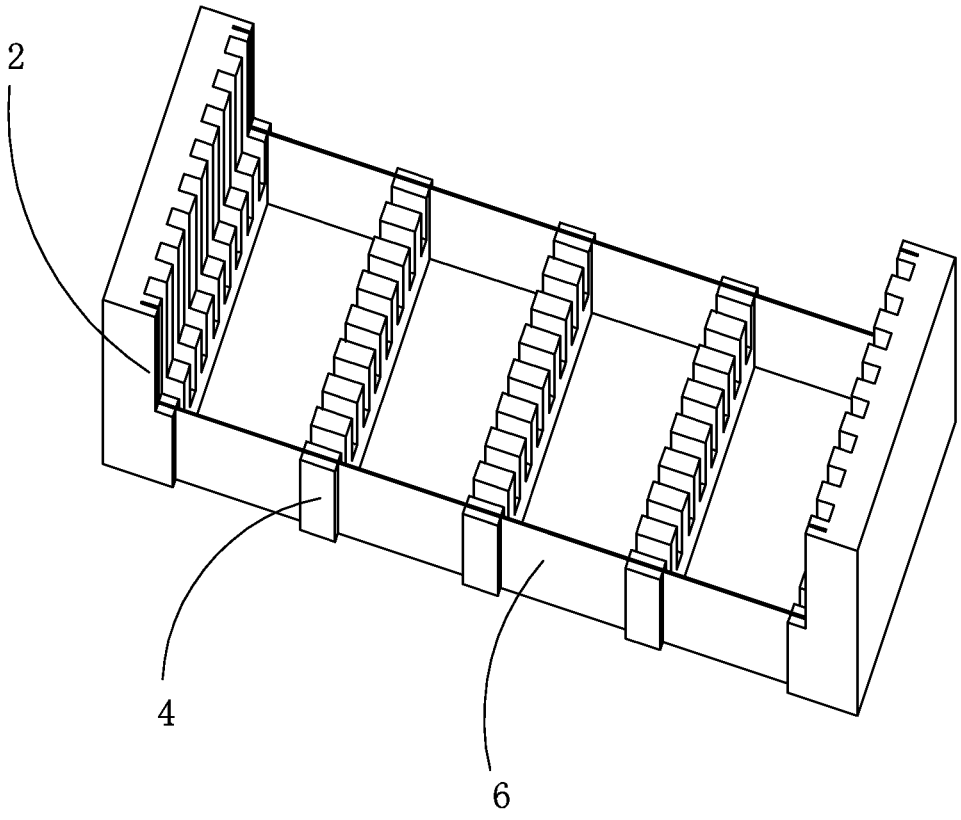
FIG. 5 is a perspective view showing the package cushioning structure for liquid crystal display module according to a preferred embodiment of the present invention.

To further expound the technical solution adopted in the present invention and the advantages thereof, a detailed description is given to a preferred embodiment of the present invention and the attached drawings.

Referring to FIGS. 4-7, the present invention provides a package cushioning structure for liquid crystal display module, which comprises: two opposite cushioning side boards 2, a plurality of cushioning position-limiting boards 4 arranged between the two cushioning side boards 2, and a plurality of connection plates 6 connecting the cushioning side boards 2 and the cushioning position-limiting boards 4.

The cushioning side boards 2 form first retention slots 22 corresponding to the connection plates 6. The cushioning position-limiting boards 4 form second retention slots 42 corresponding to the connection plates 6. The connection plates 6 forms first and second coupling sections 62, 64 respectively corresponding to the first and second retention slots 22, 42, whereby the first and second coupling sections 62, 64 are respectively received in and retained by the first and second retention slots 22, 42 to couple the cushioning side boards 2 and the cushioning position-limiting boards 4 together in a releasable manner.

The cushioning side boards 2 forms a plurality of spaced mounting slots 24 and the cushioning position-limiting boards 4 form a plurality of position-limiting slots 44 corresponding to the mounting slots 24. In the instant embodiment, the second retention slots and the position-limiting slots 44 are arranged at the same side of the cushioning position-limiting boards 4 and the first and second coupling sections 62, 64 are arranged at the same side of the connection plates 6.

The position-limiting slots 44 have a width that is equal to width of the mounting slots 24 and is greater than or equal to thickness of a liquid crystal display module, whereby the liquid crystal display module is receivable and accommodated in the position-limiting slots 44 and the mounting slots 24.

In the instant embodiment, the connection plates 6 are of a number of two and are made of corrugated boards or hollow polypropylene (PP) boards. The two cushioning side boards 2 each form two first retention slots 22 corresponding to the two connection plates 6 and respectively arranged at opposite ends of each of the two cushioning side boards 2. The mounting slots 24 uniformly distributed between the two first retention slots 22. The first retention slots 22 have a width less than that of the mounting slots 24 and smaller than or equal to thickness of the connection plates 6. The cushioning position-limiting boards 4 are of a number of three. Each of the cushioning position-limiting boards 4 forms two second retention slots 42. The two second retention slots 42 are arranged at opposite ends of the cushioning position-limiting board 4 and corresponding to the first retention slots 22. The position-limiting slots 44 are uniformly distributed between the two second retention slots 42. The second retention slots 42 have a width that is equal to that of the first retention slots 22. In other words, the width of the second retention slots 42 is also smaller than or equal to the thickness of the connection plates 6. The cushioning side boards 2 are set in an inverted "L" shape with the first retention slots 22 and the mounting slots 24 extending from a short limb of the cushioning side boards 2 toward a long limb.

Figure 6:
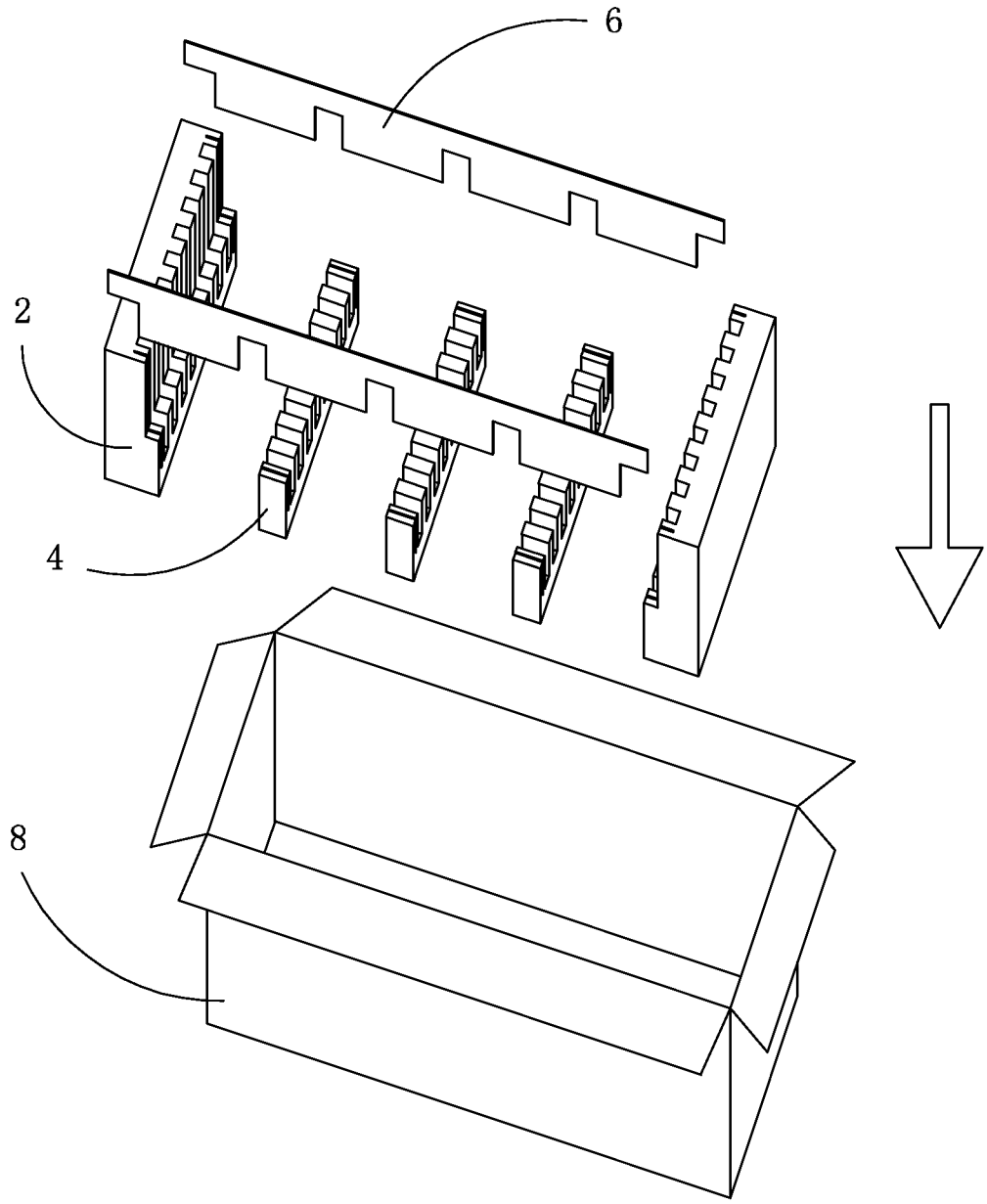
FIG. 6 is a schematic view illustrating placing the package cushioning structure for liquid crystal display module in a case according to a preferred embodiment of the present invention.

Referring to FIG. 6, in packaging a liquid crystal display module, the cushioning side boards 2 and the cushioning position-limiting boards 4 are first placed into a packing case 8. Then, the connection plates 6 are fit to and connect between the cushioning side boards 2 and the cushioning position-limiting boards 4 to fix relative position between the cushioning side boards 2 and the cushioning position-limiting boards 4. Afterwards, liquid crystal display modules (not shown in the drawing) are respectively fit into the mounting slots 22, whereby lower edges of the liquid crystal display modules are received in the position-limiting slots 44 of the cushioning position-limiting boards 4 to further secure the liquid crystal display modules in position for protection of the liquid crystal display modules against any damage caused by external forces.

Figure 7:
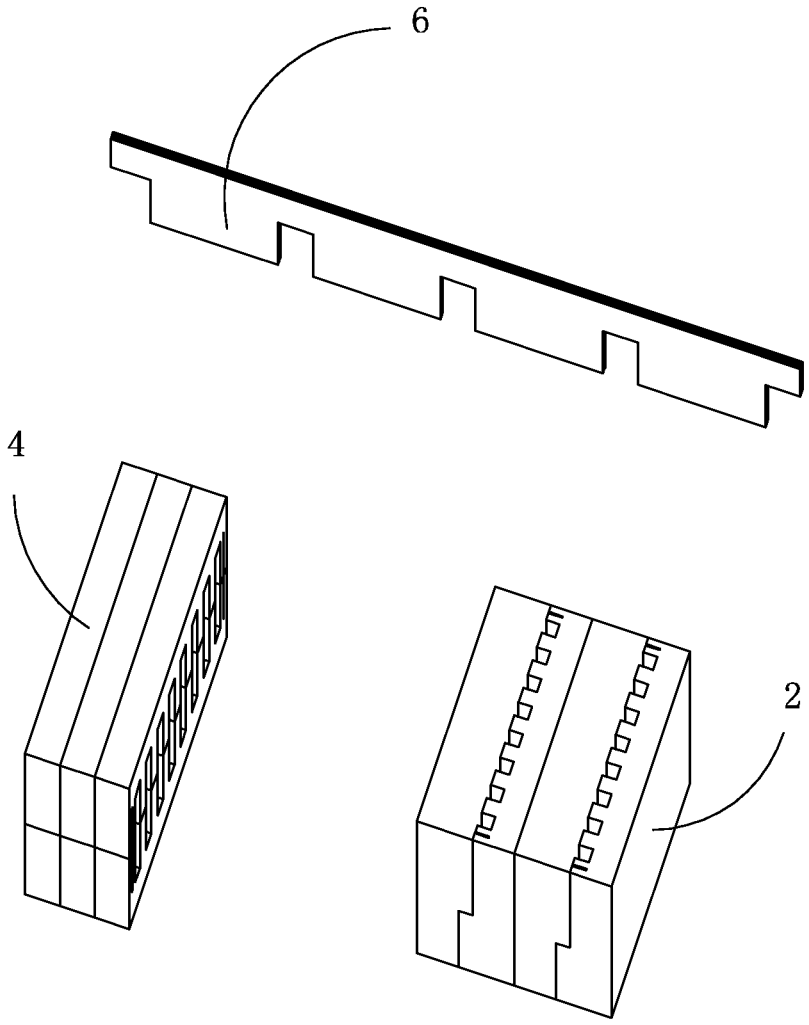
FIG. 7 is a schematic view showing baling of components of package cushioning structure for liquid crystal display module according to the present invention in shipping.

To transport the package cushioning structures, components that are identical can be bundled or baled together, as shown in FIG. 7, which is a schematic view showing identical components of two such package cushioning structures are baled together, in which the number of the cushioning side boards 2 is four, that of the cushioning position-limiting boards 4 is six and that of the connection plates 6 is four. Taking a package cushioning structure for 31.5" liquid crystal display module as an example, such a way of baling provides the following baled volumes: 14703678 mm3 for the baled cushioning side boards 2, 7514100 mm3 for the baled cushioning position-limiting boards 4, and 1021200 mm3 for the baled connection plates 6, whereby the total sum of the volumes is 14703678+7514100+1021200=23238978 mm3, which is reduced by approximately half of the total volumes of two conventional package cushioning structures, which is 44984412 mm3. Consequently, space can be effectively saved and the transportation cost is effectively lowered down.

Figure 8:
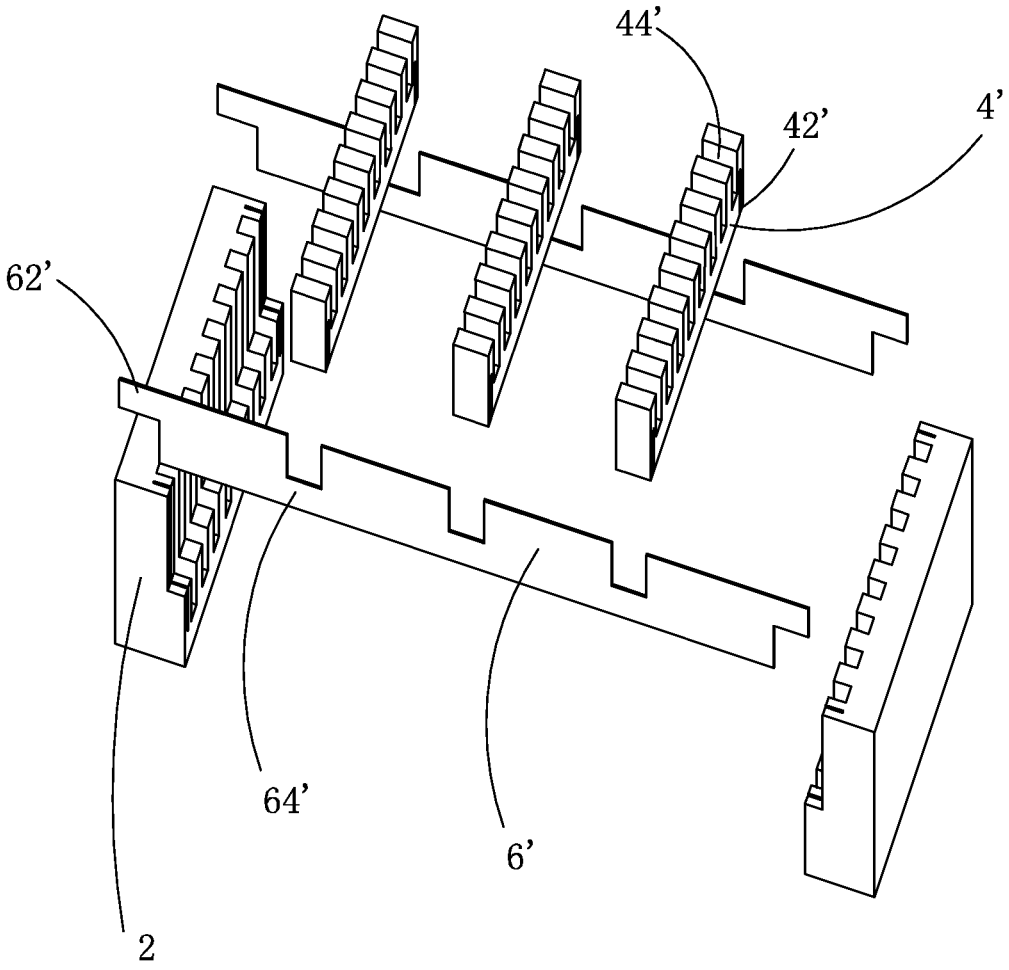
FIG. 8 is an exploded view showing a package cushioning structure for liquid crystal display module according to another preferred embodiment of the present invention.
Figure 9:
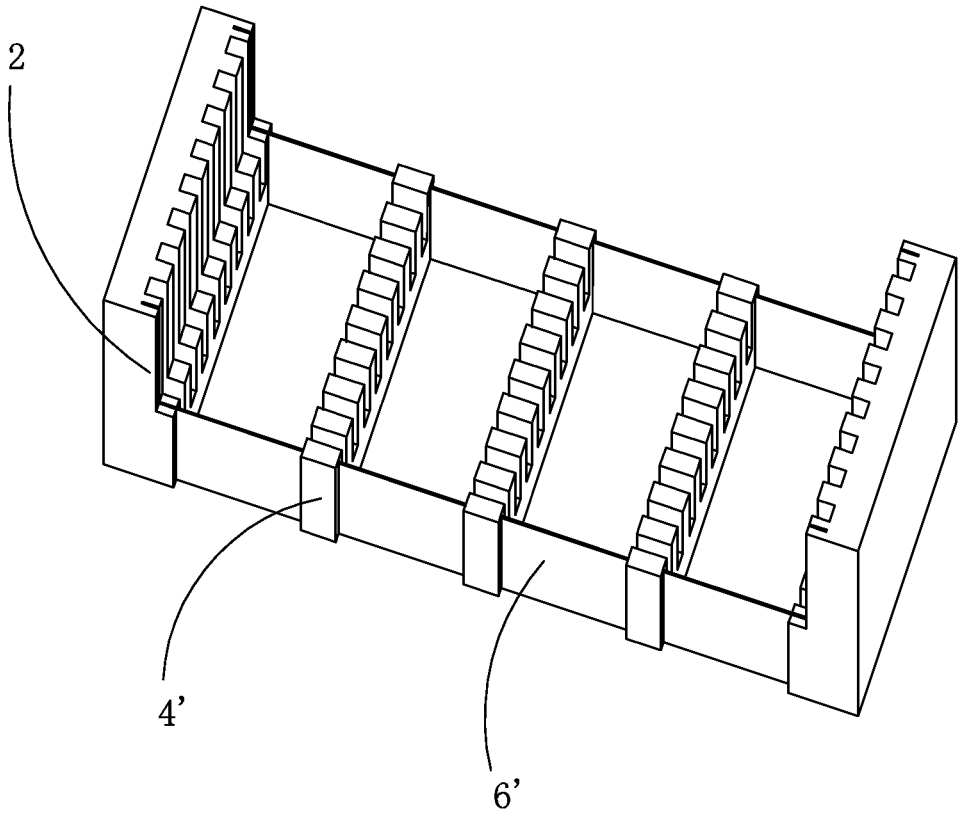
FIG. 9 is a perspective view showing the package cushioning structure for liquid crystal display module according to said another preferred embodiment of the present invention.

Referring to FIGS. 8 and 9, which shows schematic views of a package cushioning structure for liquid crystal display module according to another preferred embodiment of the present invention, in the instant embodiment, the second retention slots 42' and the position-limiting slots 44' are respectively formed in opposite sides of the cushioning position-limiting boards 4' and the first and second coupling sections 62', 64' are respectively formed in opposite sides of the connection plates 6'.

To assemble, the connection plates 6' and the cushioning side boards 2 are first connected to each other engagement made between the first retention slots 22 and the first coupling sections 62'. Then, the second retention slots 42' of the cushioning position-limiting boards 4' are fit to the second coupling sections 64' to thereby connect the cushioning side boards 2 and the cushioning position-limiting boards 4' together. The instant embodiment provides the same technical effectiveness as the previous embodiment.

In summary, the present invention provides a package cushioning structure for liquid crystal display module, which uses connection plates to couple cushioning side boards and cushioning position-limiting boards together in a releasable manner to effect cushioning external forces acting on liquid crystal display modules thereby effectively protecting the liquid crystal display modules against damages caused by the external forces. Further, the cushioning structure is a separable structure, whereby identical components can be baled together for transportation so as to save a great amount of space and effectively lower down the transportation cost.

Based on the description given above, those having ordinary skills of the art may easily contemplate various changes and modifications of the technical solution and technical ideas of the present invention and all these changes and modifications are considered within the protection scope of right for the present invention.

What is claimed is:

1. A package cushioning structure for liquid crystal display modules, comprising two opposite cushioning side boards, a number of cushioning position-limiting boards arranged between the two cushioning side boards, and a number of connection plates connecting the cushioning side boards and the cushioning position-limiting boards, the cushioning side boards forming first retention slots corresponding to the connection plates, the cushioning position-limiting boards forming second retention slots corresponding to the connection plates, the connection plates having opposite side edges and comprising first and second coupling sections each of which is formed in one of the side edges, with voids being formed in the other one of the side edges to correspond thereto, in such a way that the first and second coupling sections respectively correspond to the first and second retention slots, whereby the first and second coupling sections are respectively received in and retained by the first and second retention slots to couple the cushioning side boards and the cushioning position-limiting boards together in a releasable manner.

2. The package cushioning structure for liquid crystal display modules as claimed in claim 1, wherein the cushioning side boards form a plurality of spaced mounting slots adapted to each receive therein a portion of a liquid crystal display module and the cushioning position-limiting boards form a plurality of position-limiting slots corresponding to the mounting slots and adapted to each receive therein a portion of a liquid crystal display module.

3. The package cushioning structure for liquid crystal display modules as claimed in claim 2, wherein the position-limiting slots have a width that is equal to width of the mounting slots and is greater than or equal to the thickness of a liquid crystal display module.

4. The package cushioning structure for liquid crystal display modules as claimed in claim 2, wherein the second retention slots and the position-limiting slots are arranged at the same side of the cushioning position-limiting boards and the first and second coupling sections are located at the same one of the side edges of the connection plates.

5. The package cushioning structure for liquid crystal display modules as claimed in claim 2, wherein the second retention slots and the position-limiting slots are respectively arranged at opposite sides of the cushioning position-limiting boards and the first and second coupling sections are respectively located at different ones of the side edges of the connection plates.

6. The package cushioning structure for liquid crystal display modules as claimed in claim 1, wherein the number of the connection plates is two.

7. The package cushioning structure for liquid crystal display modules as claimed in claim 6, wherein the two cushioning side boards each form two first retention slots respectively arranged at opposite ends of each of the two cushioning side boards, the mounting slots being uniformly distributed between the two first retention slots, the first retention slots having a width less than the thickness of the mounting slots and smaller than or equal to the thickness of the connection plates.

8. The package cushioning structure for liquid crystal display modules as claimed in claim 7, wherein the number of the cushioning position-limiting boards is three, each of the cushioning position-limiting boards forming two second retention slots, the two second retention slots being arranged at opposite ends of the cushioning position-limiting board and corresponding to the first retention slots, the position-limiting slots being uniformly distributed between the two second retention slots, the second retention slots having a width that is equal to the width of the first retention slots.

9. The package cushioning structure for liquid crystal display modules as claimed in claim 1, wherein the cushioning side boards are set in an L shape.

10. The package cushioning structure for liquid crystal display modules as claimed in claim 1, wherein the connection plates are made of corrugated board or hollow Polypropylene (PP) boards.

11. A package cushioning structure for liquid crystal display modules, comprising two opposite cushioning side boards, a number of cushioning position-limiting boards arranged between the two cushioning side boards, and a number of connection plates connecting the cushioning side boards and the cushioning position-limiting boards, the cushioning side boards forming first retention slots corresponding to the connection plates, the cushioning position-limiting boards forming second retention slots corresponding to the connection plates, the connection plates having opposite side edges and comprising first and second coupling sections each of which is formed in one of the side edges, with voids being formed in the other one of the side edges to correspond thereto, in such a way that the first and second coupling sections respectively correspond to the first and second retention slots, whereby the first and second coupling sections are respectively received in and retained by the first and second retention slots to couple the cushioning side boards and the cushioning position-limiting boards together in a releasable manner;

wherein the cushioning side boards form a plurality of spaced mounting slots and the cushioning position-limiting boards form a plurality of position-limiting slots corresponding to the mounting slots;

wherein the position-limiting slots have a width that is equal to width of the mounting slots and is greater than or equal to the thickness of a liquid crystal display module;

wherein the two cushioning side boards each form two first retention slots respectively arranged at opposite ends of each of the two cushioning side boards, the mounting slots being uniformly distributed between the two first retention slots, the first retention slots having a width less than the thickness of the mounting slots and smaller than or equal to the thickness of the connection plates;

wherein each of the cushioning position-limiting boards forms two second retention slots, the two second retention slots being arranged at opposite ends of the cushioning position-limiting board and corresponding to the first retention slots, the position-limiting slots being uniformly distributed between the two second retention slots, the second retention slots having a width that is equal to the width of the first retention slots;

wherein the cushioning side boards are set in an L-shape;

wherein the connection plates are made of corrugated board or hollow polyproylene (PP) boards; and wherein the second retention slots and the position-limiting slots are arranged at the same side of the cushioning position-limiting boards and the first and second coupling sections are located at the same one of the side edges of the connection plates.

* * * * *